United States Patent [19]

Courtney

[11] Patent Number: 4,779,554

[45] Date of Patent: Oct. 25, 1988

[54] RIGID DIVER BACKPACK WITH INTERNAL BUOYANCY COMPENSATOR AND BALLAST COMPARTMENT

[76] Inventor: William L. Courtney, 3000 Steiner St., San Francisco, Calif. 94123

[21] Appl. No.: 785,906

[22] Filed: Oct. 9, 1985

[51] Int. Cl.[4] ..... B63C 11/02

[52] U.S. Cl. ..... 114/315; 405/186; 441/41; 441/92; 441/96; 441/116

[58] Field of Search ..... 405/186; 114/315; 128/202.14, 40–42; 441/6, 7, 23, 24, 27, 30, 92, 96, 106, 108, 111, 112, 114–119

[56] References Cited

U.S. PATENT DOCUMENTS

| | | | |
|---|---|---|---|
| 4,016,616 | 4/1977 | Walters | 405/186 |
| 4,054,132 | 10/1977 | Deeds | 128/202.14 |
| 4,240,371 | 12/1980 | Perry | 441/6 |

*Primary Examiner*—Sherman D. Basinger
*Attorney, Agent, or Firm*—John A. Bucher

[57] ABSTRACT

A backpack is disclosed for use with scuba gear wherein the backpack includes a rigid housing substantially enclosing an air tank, an interior chamber vented to the surrounding water and formed by the rigid housing for receiving an inflatable buoyancy compensator and a mounting for receiving and securing an adjustable amount of retrievable ballast. The rigid backpack provides a particularly streamlined configuration for the scuba gear, greater puncture resistance for the buoyancy compensator and greater variation in the amount of ballast carried by the diver. The backpack is preferably configured to better support the weight of the scuba gear upon the diver with a trim bladder separately inflatable by the diver and arranged between the backpack and the diver for allowing the diver to adjust for variations in slack, particularly at different diving depths. A power inflator device for the scuba gear preferably includes a single control device for sequentially and adjustably pressurizing a buoyancy compensator, a life vest and/or an inflatable device or transport raft attached to the air tank, a separate control device being provided for permitting the diver to pressurize the trim bladder independently of the buoyancy compensator. An emergency marking device also forms a portion of the scuba gear of the invention.

10 Claims, 5 Drawing Sheets

RIGID DIVER BACKPACK WITH INTERNAL BUOYANCY COMPENSATOR AND BALLAST COMPARTMENT

FIELD OF THE INVENTION

The present invention relates to scuba gear and more particularly to improvements in scuba gear including a backpack for use by the diver in carrying the scuba gear.

BACKGROUND OF THE INVENTION

Numerous designs for scuba gear components have been disclosed in the prior art to facilitate use of the gear by divers. It is of course important for the diver to be able to rapidly and effectively manipulate the scuba gear for maintaining a supply of air to support breathing, for regulating buoyancy of the diver under water and for permitting the diver to return to the surface, possibly under emergency conditions.

In the event that the diver desires to return to the surface, particularly under emergency conditions, the safety of the diver is of course of primary importance. However, it is also desirable that he be able to either keep the relatively expensive scuba gear with him as he returns to the surface or to have the scuba gear return to the surface by itself. This capability is important not only to recover the scuba gear but also for providing mental assurance to the diver so that he is more positively conditioned to release or jettison all or part of the scuba gear in the event of a potential emergency. In such situations, the knowledge by the diver that the scuba gear will not be lost will enable him to more readily jettison the gear and thereby enable him to readily deal with emergency conditions under water.

As is well known among those who commonly use such gear for underwater diving, the term "scuba" is an acronym for self-contained, underwater breathing apparatus. Scuba apparatus or gear commonly includes a tank containing compressed air in order to provide the diver with an underwater supply of air or oxygen. The tank is commonly mounted on the diver's upper torso or back by means of a suitable backpack. Scuba gear also commonly includes a buoyancy compensator which the diver wears and can selectively pressurize in order to adjust his buoyancy under water.

Scuba gear for use in situations of the type outline above was disclosed in copending U.S. patent application Ser. No. 747,005 and now U.S. Pat. No. 4,681,552, entitled COMBINED LIFE VEST DEVICE AND BUOYANCY COMPENSATOR, filed on June 20, 1985 by William L. Courtney and copending U.S. patent application Ser. No. 664,238 entitled SCUBA GEAR WITH COMBINED FLOTATION AND TRANSPORT DEVICE, filed on Oct. 24, 1984 also by William L. Courtney. The second reference noted above related to a backpack including quick release means so that the diver could readily free himself from the compressed air tank. An inflatable transport raft was secured to the tank for the purpose of returning the tank to the surface and also to provide transport means for the diver on the surface of the water.

The first reference noted above related to a combined life vest device and buoyancy compensator comprising separate inflatable chambers so that the diver could adjust his underwater buoyancy without interfering with his freedom of movement, the diver also being able to selectively inflate the life vest when necessary or desirable.

Those copending applications are incorporated herein as though set out in their entirety to assure a more complete understanding of the present invention since certain features fro those references are included in the following disclosure.

Various combinations of components for scuba gear have been disclosed in the prior art. For example, Maness U.S. Pat. No. 4,324,234 disclosed a personal flotation device containing two structurally and functionally independent chambers for assisting pilots and other passengers in helicopters and the like to escape after emergency landings at sea. The Maness patent also disclosed a rebreathing tube to permit the wearer to use the flotation device as an emergency air supply.

Other prior art references include, for example, Scott U.S. Pat. 4,176,418 issued Dec. 4, 1979; Roberts U.S. Pat. No. 3,747,140 issued July 24, 1973; Walters U.S. Pat. No. 4,016,616 issued April 12, 1977; Walters U.S. Pat. 3,670,509 issued June 20, 1972; and Greenwood U.S. Pat. No. 3,436,777 issued Apr. 8, 1969.

The Scott patent disclosed apparatus for regulating pressurization of a buoyancy compensator from a tank of compressed air.

The Roberts patent disclosed the use of inflation apparatus with a quick release coupling for interconnecting a compressed air tank with a buoyancy compensator in the form of an inner tube and commonly referred to as a "horse collar".

The two Walters patents disclosed similar scuba gear with an inflatable buoyancy compensator secured to the compressed air tank and mounted on the same backpack as the air tank. Through this combination, the diver could inflate the buoyancy compensator in order to adjust his effective underwater weight or buoyancy. The earlier Walters patent in particular also disclosed the backpack being hollow to provide a chamber for containing ballast. As noted in the Walters patents, it is not always possible to accurately predict the amount of extra weight a diver must wear in order to achieve neutral or slightly negative buoyancy under water. Accordingly, the Walters backpack provided a compartment for receiving a variable amount of ballast at least to the extent of the interior volume of the backpack. At the same time, the Walters buoyancy compensator could be inflated or deflated as necessary in order to maintain desired underwater buoyancy.

The Walters ballast is described as being releasable in that a door on the hackpack can be opened by the diver to permit particles of ballast to escape and reduce the ballast carried by the diver. However, the Walters system is believed to be susceptible to corrosion so that significant mechanical leverage is required to release the ballast. After substantial periods of time, it might not even be possible for the diver to even open the door and release the ballast. Also, after the ballast is released irom the Walters backpack, it is lost and not available for later use. Thus, the cost of replacing the ballast could interfere with judicious operation of the scuba equipment by the diver unlike the present invention, as described in greater detail below.

Additionally, known prior art scuba systems have operated with unique ballast systems configured for specific applications so that the diver must transport duplicate ballast systems to the dive site if he anticipates different diving conditions, for example, free diving or "skin diving" before or after scuba diving. Furthermore, current ballast systems other than weight belts have been located substantially above the divers normal center of gravity. This arrangement has compromised the ability of the diver to move out of the water, particularly during entry and exit through heavy surf which could much more easily set the diver with substantial weight located above his normal center of gravity.

In addition to problems suggested in the above noted references, it is also desirable for a diver to be able to deal with or overcome difficulties in a variety of situations. Greenwood in particular provided adjustable buoyancy in a buoyancy compensator while permitting the diver to rapidly jettison all or part of his scuba gear. However, after being jettisoned or discarded under water, the scuba gear was not readily recoverable.

In this regard, when a diver removes his compressed air tank or other scuba gear components before returning to the surface, under emergency conditions or otherwise, it is desirable to provide flotation means for permitting the tank and other scuba gear components to return to the surface for recovery and reuse by the diver. As noted above, this is particularly desirable since it conditions the diver to more readily discard his scuba gear when necessary, thus enabling him to more effectively deal with threatened emergency situations in timely fashion.

Furthermore, in the use of scuba gear as disclosed by all of the above noted patents, the generally bulky configuration of the scuba gear tends to interfere with rapid and efficient underwater movement of the diver, particularly divers operating in kelp, for example. Obviously, it remains desirable to facilitate movement of the diver under water in order to permit him to conserve his strength and to accomplish more during each dive.

At the same time, it is also apparent that scuba gear construction, as exemplified by the above references, is relatively complex. Thus, the diver is required to perform numerous operations while under water in order to maintain the scuba gear in proper operating condition. For example, the diver must continually adjust the degree of inflation in his buoyancy compensator in order to maintain the desired degree of buoyancy at any depth.

Also, the diver's wet or dry suit experiences increased compression due to greater pressures at increased underwater depths. Accordingly, as the diver descends into the water and later ascends out of the water, the varying compression of his diving suit tends to cause increased or decreased "slack" in straps which secure the scuba gear to the diver's body. Commonly, as the diver descends into the water and his suit becomes more compressed by greater pressure, it is necessary to take up some slack in the straps so that various components of his scuba gear remain firmly in place. Similarly, as the diver rises through the water after completing a dive, his suit decompresses and it is necessary to increase slack in the straps so that they do not become overly binding on the diver.

Additional prior art designs for scuba gear have provided mechanical compensators in the straps to provide some automatic adjustment in this regard. However, these designs have relied upon operation of mechanical tensioning components in which excess tension is generated mechanically before the dive in order to absorb slack developing during the dive as the diver's suit compresses. The effectiveness of these systems is limited in that the mechanism can generate only as much tension as the diver can tolerate on the surface of the water. Thus, their effectiveness is limited, particularly for dives to greater depths where increased compression of the diver's suit is experienced. In such circumstances, tensioning mechanisms of the type referred to above may not be able to satisfactorily absorb all slack developed in the diver's straps.

Accordingly, there has been found to remain a need for improved scuba gear capable of facilitating its use by a diver under water while making it easier for the diver to function under water and to assure the safe return of the diver and his equipment to the surface when desired or necessary.

SUMMARY OF THE INVENTION

It is therefore an object of the invention to provide improved scuba gear capable of overcoming one or more problems of the type outlined above.

It is a further object of the invention to provide a backpack for scuba gear, the backpack comprising a rigid housing including means for receiving and securing an air tank or the like, the rigid housing forming an interior chamber for containing an inflatable buoyancy compensator and means also formed by the rigid housing for receiving and securing ballast, preferably in the form of a standard adjustable weight belt including a conventional quick release coupling.

It is a related object of the invention to provide such a backpack wherein operation of the quick release coupling on the ballast permits the ballast to be dependably released from the backpack under the influence of gravity.

It is yet another related object of the invention to provide such a backpack wherein the rigid housing has a smooth and streamlined outer shell which is hydronamically designed to facilitate underwater movement of the diver.

Yet a further related object of the invention is to provide such a backpack including additional means for facilitating comfortable mounting of the backpack and associated scuba gear components upon the diver's back.

An even further related object of the invention, either in combination with the above noted backpack or with other scuba gear devices, is the provision of a trim bladder arranged on an inner surface of the backpack or other device worn by the diver so that the trim bladder is positioned between the backpack or device and the diver, means being provided for coupling the trim bladder with a source of air or gas under pressure in order to permit the diver to selectively inflate or deflate the trim bladder in order to increase or decrease slack in straps securing the scuba gear in place on the diver.

It is yet a further object of the invention to provide scuba gear of a type including a buoyancy compensator and a separate life vest for the diver, a power inflator device being adapted for sequentially pressurizing the buoyancy compensator and life vest (and possibly a life raft as noted below) through a single control device operated by the diver.

It is a further related object of the invention to provide such a power inflator device wherein the cuba gear further comprises an inflatable device, preferably a transport craft or life raft, coupled with the air tank, the power inflator device also being adapted for sequentially pressurizing the inflatable device on the air tank through the same single control.

Yet a further related object of the invention is to provide scuba gear of the type noted above and further comprising a trim bladder, the power inflator device comprising a separate control for regulating pressurization of the trim bladder independently of the buoyancy compensator.

It is another object of the invention to provide an emergency marker device including fixed buoyancy means and optionally inflatable buoyancy means each capable of rising to the surface to perform a marking function.

Additional objects and advantages of the invention are made apparent in the following description having reference to the accompanying drawings.

DESCRIPTION OF THE PREFERRED EMBODIMENT

Figure 1:
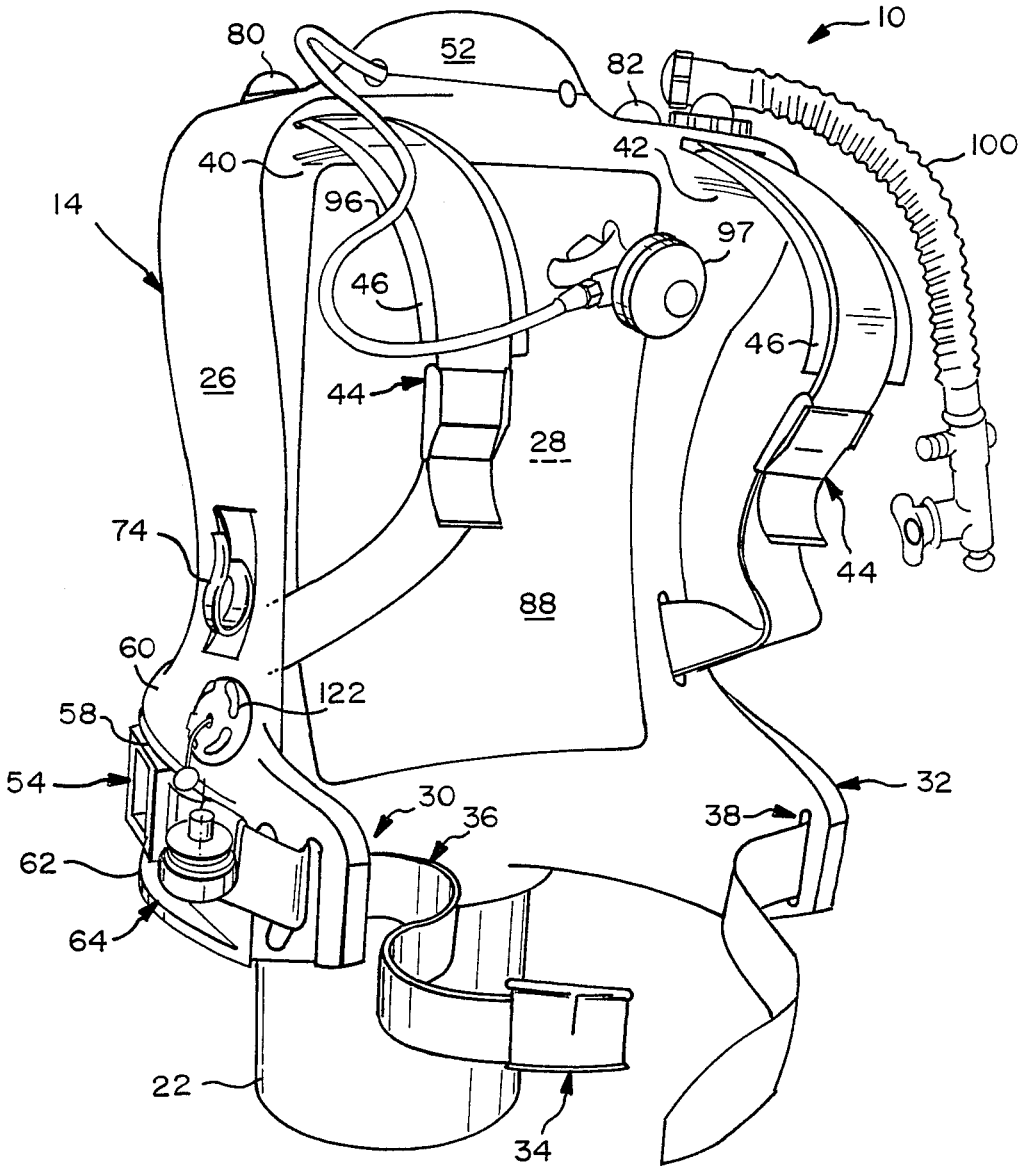
FIG. 1 is an isometric view of a rigid backpack forming an internal buoyancy compensator chamber and ballast mounting means in accordance with the present invention without a trim bladder which is shown in other of the FIGURES.

Referring now to the drawings and particularly to FIG. 1, a backpack 10 is illustrated for use with scuba gear indicated at 12. The backpack 10 of the invention includes, as a particularly important feature, a rigid housing 14 including an internal chamber 16 vented to the surrounding water and ballast mounting means 18. As described in greater detail below, the backpack 10 also includes means 20 for receiving and securing an air tank 22 in place upon and within the backpack. The air tank and associated hoses are preferably substantially entirely enclosed with the backpack in order to provide even greater streamlining.

Figure 3:
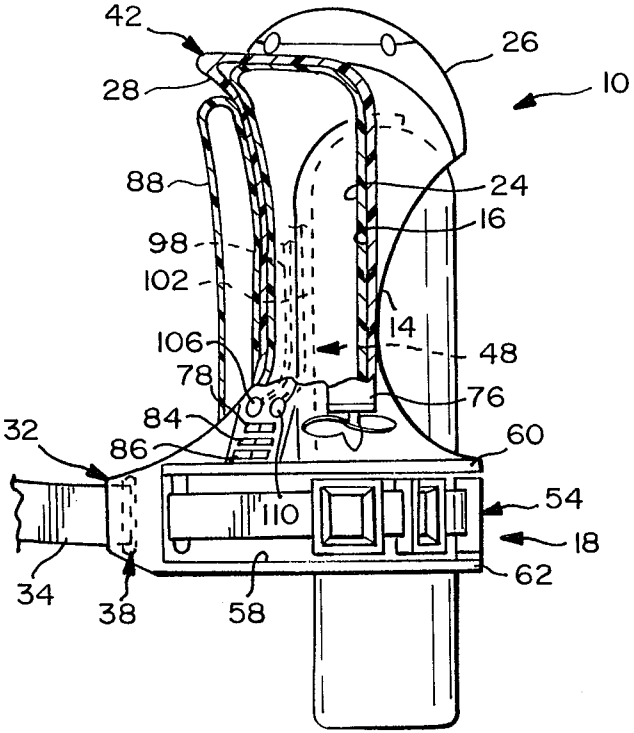
FIG. 3 is a view of the opposite side of the backpack from that shown in FIG. 2, a portion of the backpack being broken away in FIG. 3 to illustrate its internal construction and also to better illustrate the arrangement of a trim bladder with respect to the backpack.

The buoyancy compensator chamber 16 is internally formed within the rigid housing 14 for containing a flexible buoyancy compensator container 24 (see FIG. 3). The backpack also forms ballast mounting means 18 which preferably opens outwardly from the housing as described in greater detail below.

The backpack 10 thus offers a number of particularly important advantages for use with scuba gear. Initially, an outer shell 26 of the backpack or housing 14 is formed with a smooth and streamlined contour for minimizing drag as the diver moves under water. At the same time, the hard shell 26 of the housing provides greater puncture and tear resistance for the buoyancy compensator container or bladder 24.

The rigid backpack 10 is preferably formed from structural foam or other low density material so that the backpack itself provides inherent fixed buoyancy for the scuba gear. The inherent fixed buoyancy provided by the backpack can be in excess of the amount of negative buoyancy for the entire backpack or scuba system less the ballast. Therefore, even upon failure of the first stage regulator, referred to below and indicated at 98, interrupting operation of both high pressure and low pressure systems of the scuba gear and preventing inflation of either the buoyancy compensator or trim bladder referred to below, recovery or salvage of the backpack would be assured.

For example, it is estimated that the above purpose could be accomplished by providing about 6 to 10 pounds of fixed or inherent buoyancy in the backpack. With the buoyancy compensator intact, the device could support 30 to 80 pounds of gear, for example.

Even further, the rigid backpack forms an ideal base for mounting various attachments such as lights, motors, marking devices, cameras, flashlights, etc. As noted above, all of this equipment is preferably attached directly to the backpack and would thus be assured of salvage in case the scuba gear were jettisoned.

The manner in which the invention provides these advantages while also realizing additional functions and advantages is described in greater detail below.

Figure 2:
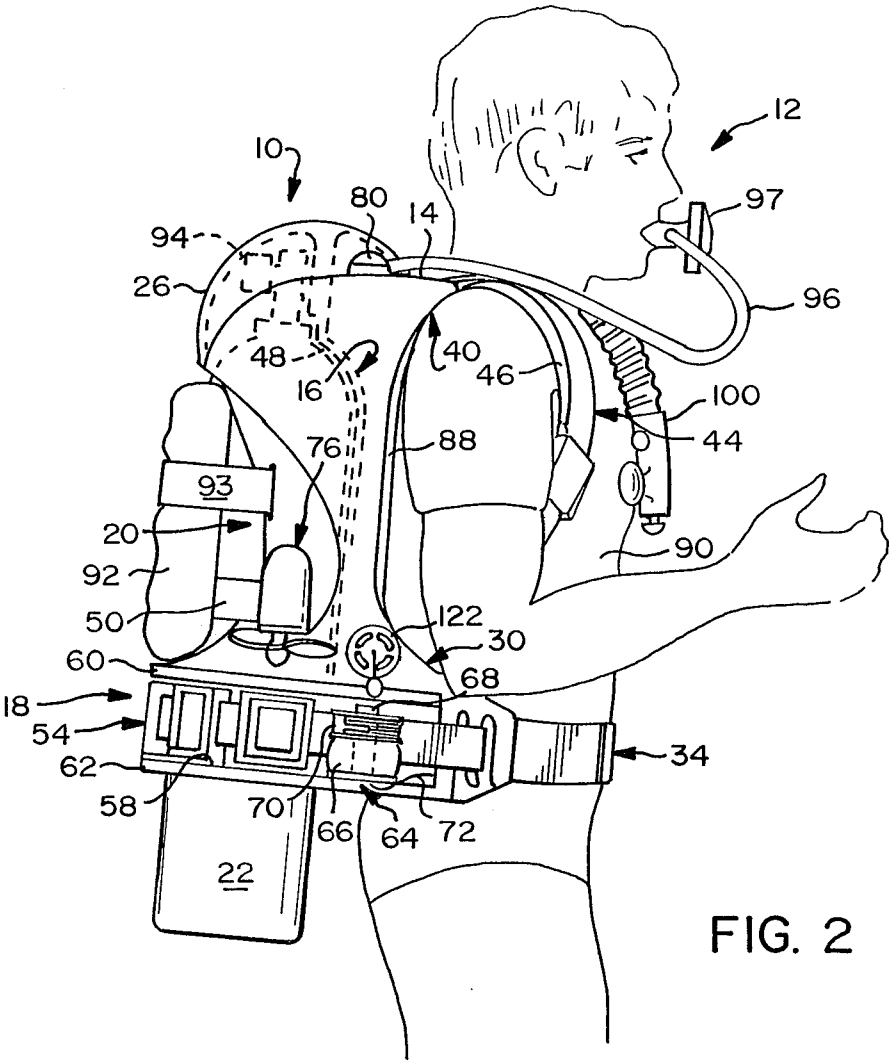
FIG. 2 is a side view of a diver wearing both a life vest and the backpack of the invention with an air tank supported in place upon and within the backpack, internal features of the backpack being shown in phantom.
Figure 4:
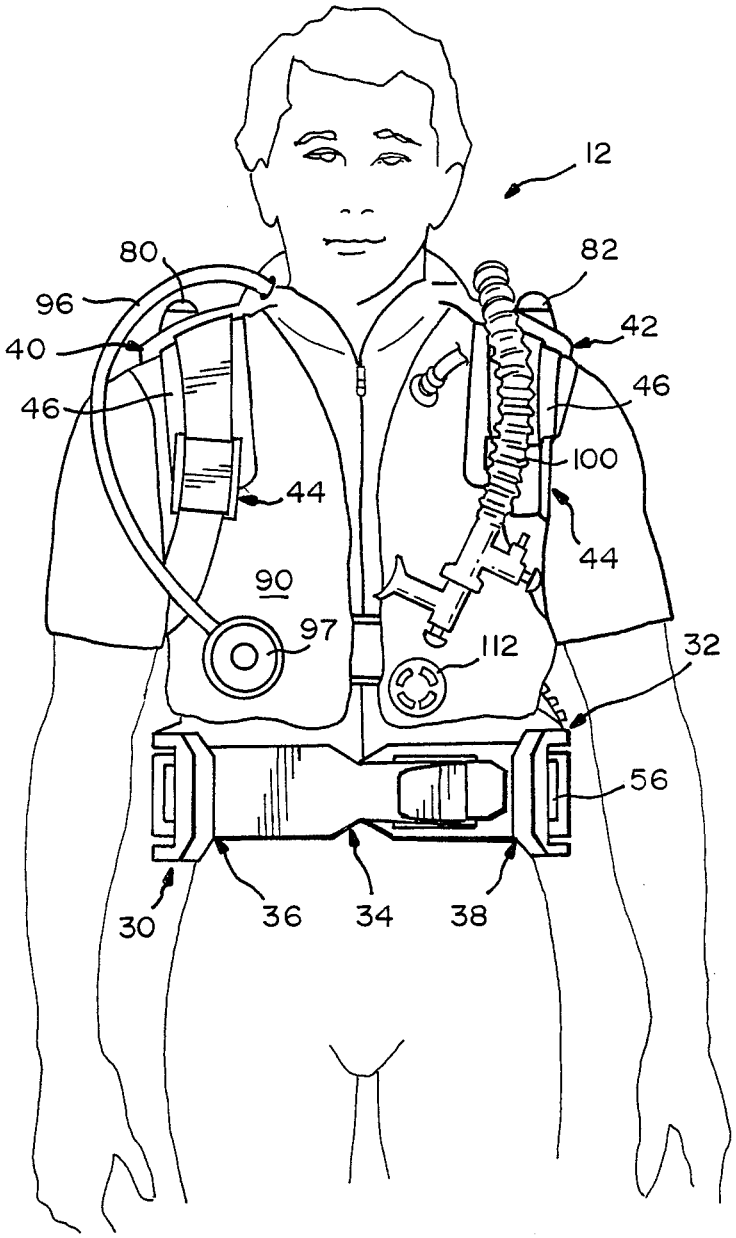
FIG. 4 is a front view of the diver wearing the backpack of the invention, as viewed for example from the right side of FIG. 2.

Referring particularly to FIGS. 1–3, the backpack 10 is configured so that it can be comfortably mounted upon the diver's back. For this reason, an inwardly facing surface 28 has a generally free form shape designed to generally conform with the contours of the diver's back. In addition, projections 30 and 32 extend forwardly from lower lateral portions of the backpack generally adjacent the diver's hips. As may be best seen in FIGS. 2 and 4, a waist belt 34 is anchored at 36 and 38 to these projections. Especially with the waist belt 34 in place as illustrated in FIG. 4, the projections 30 and 32 permit a portion of the weight of the backpack and associated scuba components to be carried upon the diver's hips generally in the manner of backpack designs used to carry large loads during hiking.

Similarly, projections 40 and 42 extend forwardly from lateral upper portions of the backpack generally adjacent the diver's shoulders. Shoulder straps 44 are respectively anchored to these projections and extend downwardly for connection with the waist belt 34. The shoulder straps 44 as well as the waist belt 34 all include heavily padded portions 46 at least near the points of support on the diver to better distribute the weight of the backpack. The combination of features described above particularly adapt the backpack for fitting on a diver's back.

Figure 5:
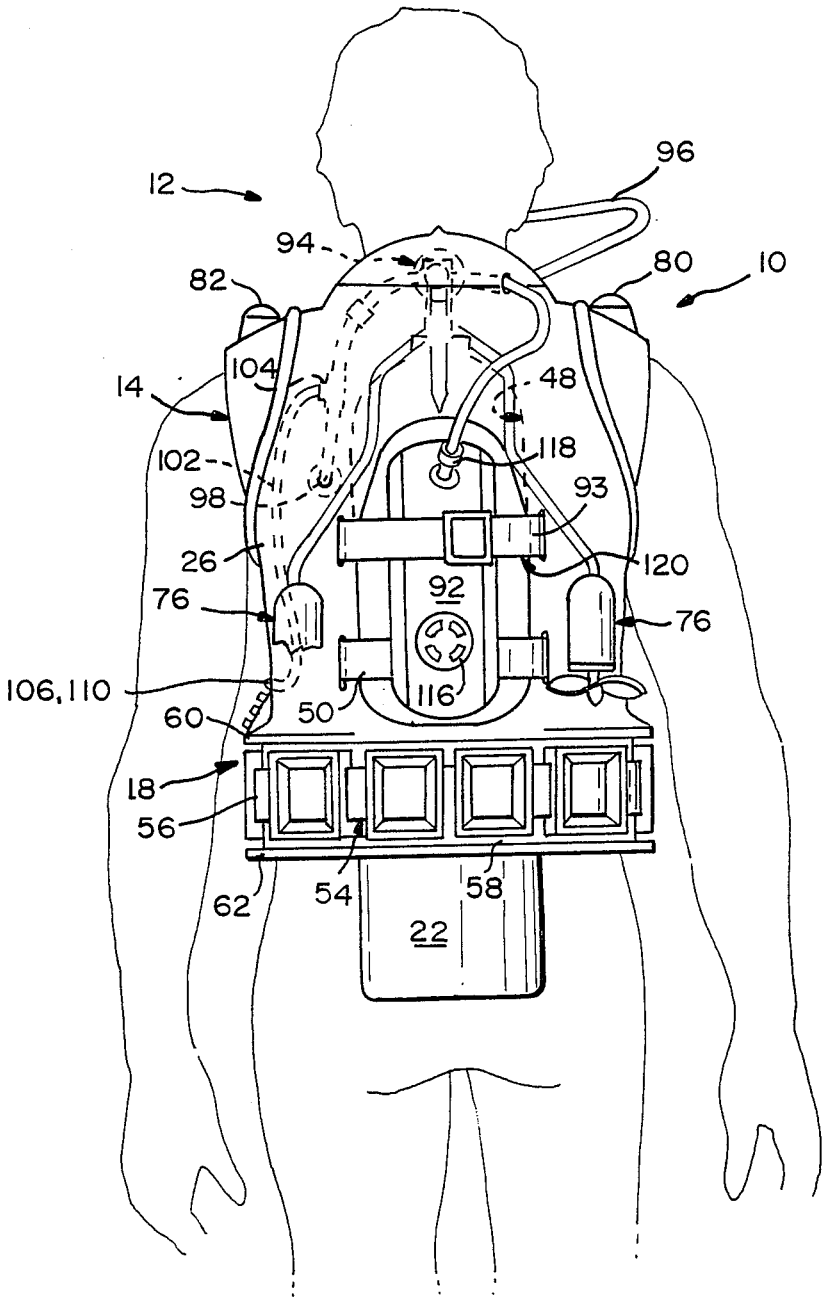
FIG. 5 is a back view of the diver also wearing the backpack of the invention, taken for example from the left side of FIG. 2.
Figure 6:
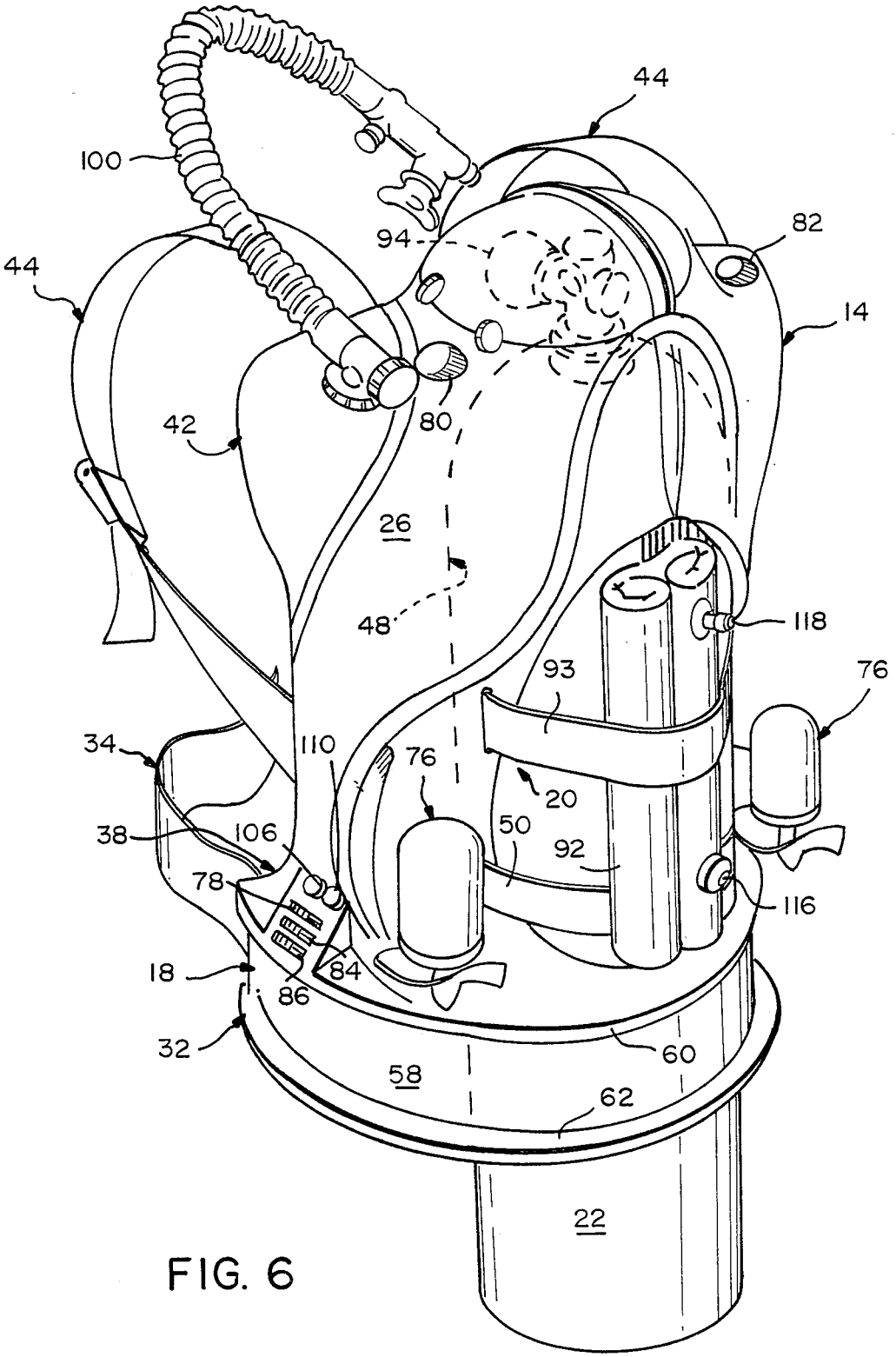
FIG. 6 is a view of the backpack from the rear and by itself to better illustrate its streamlined construction.

Referring now to FIG. 6, the air tank 22 is secured in place upon and within the backpack by the means 20 including a centrally arranged, longitudinally extending recess 48 shaped to receive the air tank in generally nested relation. With the air tank 22 in place within the recess 48, it is held in place by straps 50 as may be best seen for example in FIGS. 2 and 5. Referring also to FIG. 2 and 3, the internal chamber 16 for the buoyancy compensator container 24 extends into all available interior space of the backpack, about the air tank 22, including the sides of the recess 48 and transversely across an upper portion of the backpack above the recess 48. As may be best seen in FIG. 3, the flexible buoyancy compensator container 24 generally conforms with while being slightly larger than the interior of the internal chamber 16 so that stress of inflation is transferred to the rigid backpack. A door 52 is preferably arranged in a portion of the backpack to provide access to the internal chamber 16, for example, to permit installation and replacement as necessary of the buoyancy compensator container 24, batteries for lights and motors, etc.

As was noted above, the rigid backpack 10 also forms ballast mounting means 18 which facilitates connection or mounting of any desired amount of ballast on the backpack. The mounting means 18 also facilitates release of all or part of a segmented ballast arrangement under the influence of gravity as is described in greater detail below. The ballast means 18 is preferably adapted for mounting ballast in the form of a conventional weight belt 54 having a quick release buckle 56 as normally used for securing such a weight belt in place about the diver's waist. Unlike prior art backpack ballast systems, the present design allows the diver to use the same ballast (or part of the ballast) even without the tank 22.

It has sometimes been found difficult with prior art systems to use excessive amounts of ballast with a weight belt on the diver's waist because of the increased weight and discomfort to the diver. As was also noted above, the weight belt has also presented a problem in the past because of the effect of substantial underwater pressures to compress the diving suit. Particularly with a relatively heavy ballast, the diver found it necessary to frequently adjust the weight belt in order to make sure that it was snugly secured about his waist without being either too loose or too tight, a procedure that can result in accidental loss of the ballast and premature termination of a dive, while also requiring continued attention of the diver.

Arrangement of the weight belt 54 upon the ballast mounting means 18 avoids these problems while positioning the ballast near the diver's lower back in order to maintain a desired center of gravity for the diver and thereby facilitate movement of the diver in heavy surf or on land, for example. At the same time, the ballast mounting means 18 includes a channel 58 formed between flanges 60 and 62 on the rigid backpack for receiving the ballast or weight belt 54. Thus, after a diver has determined the amount of ballast that he desires for a given dive, that amount of ballast may be placed on his weight belt 54, the weight belt 54 being positioned in the rigid channel 58 between the flanges 60 and 62. With the buckle 56 producing substantial tension to secure the weight belt 54 about the channel 58 of the backpack, the flanges prevent the weight belt 54 from moving or becoming disengaged from the backpack.

Mounting the weight belt on the backpack also permits the use of significantly more weight than is normally contemplated with conventional scuba gear. This excess capacity may be useful for example by a diver using a dry suit and requiring substantially increased ballast to offset the increased buoyancy of the dry suit. Additionally, the increased ballast is very useful in other situations, even with the diver wearing a wet suit, for example. When operating on the bottom of the ocean, deflation of an oversized buoyancy compensator contained in the rigid backpack to compensate for the increased ballast allows the diver to remain more firmly in place on the ocean floor. This provides stability against underwater current surges and may prevent injury which would otherwise result from the diver being swept against coral or sea urchins, for example. In addition, the increased stability provided by the present invention may similarly be useful in other underwater activities such as photography, salvage or search and recovery operations.

However, the ballast mounting means 18 is also designed to particularly facilitate release or jettisoning of the weight belt 54 when necessary or desired by the diver. Because of the arrangement of the mounting means 18, the diver can simply unfasten the quick release buckle 56 in order to disengage the weight belt. Once the buckle 56 is released, resulting expansion of the weight belt 54 permits it to slip past the lower flange 62 under the influence of gravity to assure rapid jettisoning of the ballast.

In order to further facilitate release of the weight belt 54 in potentially emergency conditions, an emergency marker device 64 is also mounted on the backpack generally adjacent the weight belt 54. Generally, the marker device 64 includes fixed buoyancy means 66 normally in the form of closed cell foam which is inherently buoyant. The device 64 also includes a compressed gas canister 68 which is operable by the diver for introducing compressed air or gas into an inflatable portion 70 of the device. The device 64 is coupled with the weight belt 54 by means of a line 72, a substantial portion of the line 72 being coiled within the device 64 to permit it to rise to the surface for carrying out its marking function. Preferably, the line 72 includes quick release means so that, in non-emergency situations, the diver may choose to uncouple the marker device from the weight belt and use it for other purposes, for example, to mark the location of found objects or the like.

As noted above, the rigid backpack also provides a particularly convenient mounting base for a number of accessories commonly employed in scuba diving. For this reason, a number of hook elements 74 are integrally formed in the surface of the backpack (see FIGS. 1–3) to provide a convenient mounting point for various accessories such as flashlights, additional lines, cameras, etc.

The rigid backpack also provides a particularly convenient location, partly because of the lateral projections 30 and 32, for mounting various controls used by the diver for regulating the scuba gear. For example, referring particularly to FIGS. 2 and 5, motor driven propeller units 76 are mounted on both sides of the backpack for use by the diver to dramatically extend underwater mobility and range. The motor driven units 76 are powered for example by batteries (not shown) arranged within the backpack itself or contained in a battery pack attached by the quick release belt to the bottom of the backpack and operated for example by a rheostat-type switch 78.

The backpack preferably comprises lighting units 80 and 82 particularly useful to the diver because of their location just above and behind his shoulders. The lights could be spotlights, floodlights or of variable focus and could be removable to permit use in different modes by the diver. The lights 80 and 82 preferably comprise a floodlight and strobe light respectively operated by the diver through an additional rheostat switch 84 and an on-off switch 86. The rheostat switches 78, 84 and 86 are all mounted on the lateral projection 32 near the diver's waist in order to be particularly convenient for use by the diver.

Additional control units for the scuba gear are also mounted on the backpack and are described further below following a description of inflation devices operated by those controls. However, before describing those inflation devices, a trim bladder 88 and the method of its control by the diver are first described.

The trim bladder 88 provides a particularly comfortable and effective means permitting the diver to adjust tension in the straps or belts securing the backpack in place as he is exposed to different underwater pressures while either descending or ascending underwater. For this purpose, the trim bladder 88 is a flexible airtight cushion or container overlapping a substantial portion of the inwardly facing surface 28 adjacent the diver's back. Rather than requiring the diver to continually adjust the waist belt 34 or shoulder straps 44 in response to different underwater pressures and different degrees of compression, or relying on self-adjusting mechanical devices which may be susceptible to failure, the trim bladder 88 provides a particularly simple means for adjusting slack in all straps or mountings of the backpack by a valve control described in greater detail below. At the same time, the trim bladder 88 provides cushioning or padding which conforms with individual contours of the diver's back to make the backpack 10 even more comfortable. The pressure control for the trim bladder 88 is described in greater detail below along with the other inflation devices in the scuba gear.

The trim bladder provides an independently inflated device which can serve as an emergency back-up for the buoyancy compensator.

Before describing the inflation devices of the invention, it is recommended that the diver also wear a life vest 90 in addition to the backpack 10. An inflatable device such as a raft 92 may also be secured to the air tank 22 by a strap 93. As noted in one of the copending references above, the raft 92 is releasably secured to the air tank 22 and is selectively inflatable in order to carry the air tank 22 or salvage objects, for example, to the surface. At the same time, the inflatable raft 92 may be employed on the surface to provide safety and transport for the diver 12.

In any event, additional scuba gear components associated with the backpack 10 include inflation devices for regulating pressure within the buoyancy compensator 24, the life vest 90 and the inflatable raft 92 as well as the trim bladder 88. Preferably, the inflation device of the present invention provides for sequential pressurization of the buoyancy compensator 24, the life vest 90 and the inflatable raft 92 in a sequential manner through a single control operated by the diver. Since it is commonly desirable for the diver to be able to simultaneously and independently adjust pressure in the buoyancy compensator 24 and in the trim bladder 88, a separate inflation control device is provided for the trim bladder 88 as described in greater detail below.

In accordance with conventional practice, and referring particularly to FIGS. 1 and 5, the air tank 22 is provided with conventional regulator apparatus 94 for admitting air under pressure from the tank into air lines 96 and 98. The air line 96 is coupled with a conventional second stage demand regulator including a breathing device for the diver (not otherwise shown).

The other air line 98 is coupled with a conventional power and manual inflation device 100 and also with another air line 102 through a T-junction 104. The air line 98 is coupled with the buoyancy compensator compartment. The air line 102 is coupled to a pressure valve 106 for a purpose described further below.

Continuing with reference to FIG. 3, a single control valve 110 operable by the diver regulates admission of air pressure into the buoyancy compensator. Similarly, the diver can relieve air pressure from the buoyancy compensator by valve means 112 FIG. 4, which simultaneously operates high and low positioned dump valves to facilitate deflation of the buoyancy compensator regardless of the diver position.

All current life vests or buoyancy compensators separately worn by the diver are similar to the life vest 90 and can thus be used in conjunction with the backpack of the present invention.

This design allows the diver to operate the entire system including the life vest or buoyancy compensator through the single control valve 110. Normal operation of the buoyancy compensator 24 is carried out in a pressure range selected to permit maximum inflation and maximum buoyancy desired for the buoyancy compensator. The life vest 90 remains uninflated until the end of the dive or the occurrence of an emergency. With the life vest being uninflated, it is easier for the diver to move and he maintains a more hydrodynamic configuration under water.

Continued operation of the single control valve 110 beyond the maximum pressure selected for the buoyancy compensator initiates inflation of the life vest. For example, should the diver desire only about ten to fifteen pounds positive buoyancy, he can disconnect his life vest by a quick release coupling. In an emergency, he can continue to inflate the life vest to maximum buoyancy before disconnecting it. The same valve 110 can also be operated to develop pressure in the buoyancy compensator and life vest above a second preselected pressure whereupon a life raft can be inflated as described below. The life raft may be used, for example, on the surface to allow an injured diver or diver suffering from hypothermia to remove himself from the low temperature environment of the water.

Referring also to FIG. 2 and FIG. 4, a relief valve 112 is operatively connected between the buoyancy compensator container 24, the single control valve 110, and the life vest 90 by means of a quick release coupling. With the relief valve 112 coupled between the buoyancy compensator and the life vest, it is preferably set to open and communicate air pressure from the buoyancy compensater to the life vest when pressure in the buoyancy compensator a first predetermined pressure level, for one pound per square inch (psi).

At the same time, referring als to FIG. 5, a relief valve 116 is operatively connected to the single control valve 110 and is provided for the inflatable raft 92. A second quick release coupling 118 is coupled with buoyancy compensator. The second relief valve 116 is set open at a second predetermined level, preferably than the first predetermined pressure level referred to above with regard to relief valve 112. For example, the second relief valve 116 may be set open when pressure in the buoyancy compensator exceeds about psi so that higher pressures in the buoyancy pass through the second relief valve 116 to inflate the raft 92. If the diver is diving without a life raft, the second relief valve 116 functions as the final relief valve for both the buoyancy compensator 24 and the life vest 90. Should the diver be diving with a life raft as described above, a third pressure relief valve set for example at a still higher pressure, for example three psi, would then serve to protect the life raft as well as buoyancy compensator 24 and life vest from overinflation.

Thus, the diver can operate the control 110 and, by being aware of positive buoyancy generated within the buoyancy compensator, use that single control either to regulate buoyancy in the buoyancy compensator alone, to also inflate the life vest 90 and also optionally to inflate the raft 92. Indicators or alarms could be used in conjunction with the relief valves 112 and 116 to assure the diver of knowing when air pressure from the buoyancy compensator is or is about to be communicated to either the life vest 90 or inflatable raft 92, preventing accidental inflation.

The air line 102 is in communication with the trim bladder 88 through the control valve 106 which is preferably mounted on the left hand projection 32 of the backpack (see FIG. 3). A dump valve 122 for the trim bladder 88 is mounted adjacent the control valve 106 so that the diver may selectively increase or decrease pressure within the trim bladder 88 to either decrease or increase slack in the waist belt 34 and shoulder straps 44 holding the backpack 10 in place.

The trim bladder is shown in a relatively deflated condition in FIG. 2. This condition might be used for example when the diver is at the surface of the water preparing for an underwater dive. As the diver goes further and further under the surface and is exposed to greater pressures, his suit is relatively compressed as noted above so that the waist belt 34 and shoulder straps 44 holding the backpack 10 in place tend to become relatively slack. At such a time, the diver could merely increase pressure within the trim bladder 88 as illustrated in FIG. 3 to take up some of the slack noted above. Increased buoyancy can also be compensated for by operating the relief or dump valve of the buoyancy compensator.

Conversely, as the diver is ascending following a dive, pressure is gradually released from the trim bladder 88 through the dump valve 122 in order to similarly introduce additional slack in the waist belt 34 and shoulder straps 44.

Accordingly, there has been described a particularly novel backpack for use by scuba divers and the like including a number of particularly novel features. Numerous modifications and variations are believed apparent from the preceding description. For example, the size of the backpack, the internal buoyancy compensator and the ballast compartment depending upon the particular application. For example, a diver using a dry suit might prefer a substantially larger backpack providing both increased ballast and buoyancy capabilities. Similarly, different sizes of backpacks might also be employed to fit divers of different sizes. However, in this regard, it is also noted that the trim bladder of the present invention serves at least partly to adapt the backpack to the size and contour of the individual diver. Accordingly, the scope of the invention is defined only by the following appended claims.

What is claimed is:

1. In scuba gear of a type used by divers and including a source of compressed gas and a device mounted upon the diver by flexible strap means surrounding a portion of the diver's body, the combination comprising a flexible trim bladder arranged upon an inwardly facing surface of the device so that it is positioned between the device and the diver in use, and means for coupling the trim bladder with the source of compressed gas, the coupling means further comprising control means permitting the diver to independently and selectively inflate and deflate the trim bladder in order to compensate for increased and decreased slack in the flexible strap means during dives.

2. The scuba gear of claim 1 wherein the source of compressed gas is an air tank also adapted for supporting breathing of the diver underwater.

3. The scuba gear of claim 2 wherein the device worn by the diver is a backpack adapted for mounting the air tank.

4. A power inflator device for use in scuba gear of a type including an air tank mounted upon the diver's back by means of a backpack, a buoyancy compensator for selectively overcoming negative buoyancy of the air tank and other portions of the scuba gear, a life vest worn by the diver and an inflatable device mounted upon the air tank, the power inflator device comprising single control means operatively coupled between the air tank and the buoyancy compensator for allowing the diver to selectively pressurize the buoyancy compensator, first valve means operatively interconnected between the buoyancy compensator and the life vest for communicating air under pressure from the buoyancy compensator to the life vest when pressure in the buoyancy compensator exceeds a first predetermined level, and second valve means operatively interconnected between the buoyancy compensator and the inflatable device on the air tank for communicating air pressure from the life vest to the inflatable device when air pressure in the buoyancy compensator exceeds a second predetermined presure level, whereby the diver may selectively pressurize the buoyancy compensator, the life vest, and the inflatable device with the single control means.

5. The power inflator device of claim 4 further comprising a trim bladder arranged between the backpack and the diver, the power inflator device further comprising an additional control means operatively interconnecting the air tank with the trim bladder for permitting the diver to selectively pressurize the trim bladder independently of the buoyancy compensator.

6. A backpack of a type used by divers with scuba gear including a compressed air tank to provide an underwater source of air and quick release means for securing the backpack on the diver while permitting the diver to rapidly free himself from the backpack, comprising a rigid housing structure adapted to substantially enclose the air tank and inflator means connected with the air tank for operation by the diver, means formed by the housing structure for receiving and securing the air tank in place, an interior chamber formed by the rigid housing structure and arranged adjacent the receiving and securing means for the air tank, a flexible buoyancy compensator arranged in the interior chamber of the rigid housing structure, the inflator means being coupled with the buoyancy compensator, the buoyancy compensator comprising outlet relief valve means adapted for communication with an inflatable life vest worn by the diver after pressure in the buoyancy compensator is raised above a first predetermined level, and mounting means also formed by the rigid housing structure for receiving and securing ballast means.

7. A backpack of a type used by divers with scuba gear including a compressed air tank to provide an underwater source of air and quick release means for securing the backpack on the diver while permitting the diver to rapidly free himself from the backpack, comprising:

a rigid housing structure, an inwardly facing surface of the rigid housing structure being configured to generally conform to the diver's back, means projecting forwardly from lower portions of the rigid housing structure on each side of the diver in proximity to the diver's waist for partially supporting the weight of the backpack on the diver's hips, means formed by the housing structure for receiving and securing the air tank in place, an interior chamber formed by the rigid housing structure and arranged adjacent the receiving and securing means for the air tank to contain an inflatable buoyancy compensator, channel means formed on the lower portion of the rigid housing structure for receiving and securing ballast means, a waist belt for the diver having opposite portions secured to the backpack adjacent the projecting means on opposite sides of the structure and adapted for interconnection by a quick release coupling, and means projecting forwardly from upper portions of the rigid housing structure for partially supporting weight of the backpack on the diver's shoulders.

8. The backpack of claim 7 further comprising a flexible trim bladder arranged upon an inwardly facing surface of the rigid housing structure so that it is positioned between the backpack and the diver in use and means for coupling the trim bladder with an inflator means to permit the diver to independently and selectively inflate and deflate the trim bladder.

9. A backpack of a type used by divers with scuba gear including a compressed air tank to provide an underwater source of air and quick release means for securing the backpack on the diver while permitting the diver to rapidly free himself from the backpack, comprising:

a rigid housing structure adapted to substantially enclose the air tank and inflator means connected with the air tank for operation by the diver, means formed by the housing structure for receiving and securing the air tank in place, an interior chamber formed by the rigid housing structure and arranged adjacent the receiving and securing means for the air tank, a flexible buoyancy compensator arranged in the interior chamber of the rigid housing structure, the inflator means being coupled with the buoyancy compensator, the buoyancy compensator comprising outlet relief valve means adapted for communication with an inflatable life vest worn by the diver after pressure in the buoyancy compensator is raised above a first predetermined level, an inflatable transport raft normally deflated and secured to the air tank, an outlet valve from the buoyancy compensator being interconnected with the inflatable transport raft for inflating the raft when pressure in the buoyancy compensator exceeds a second predetermined pressure level, whereby the diver may selectively pressurize the buoyancy compensator, the life vest and the inflatable transport raft by a single control device in the inflator means, and mounting means also formed by the rigid housing structure for receiving and securing ballast means.

10. The backpack of claim 9 further comprising a flexible trim bladder arranged upon an inwardly exposed surface of the rigid housing structure, the trim bladder being operated by a separate and independent inflation control device permitting the diver to selectively inflate and deflate the trim bladder and allowing the trim bladder to serve as an emergency backup system for the buoyancy compensator and life vest.

* * * * *